US006955451B2

(12) United States Patent
Coushaine et al.

(10) Patent No.: US 6,955,451 B2
(45) Date of Patent: Oct. 18, 2005

(54) LAMP WITH LED SUBSTRATES SUPPORTED BY HEAT CONDUCTIVE POST, AND METHOD OF MAKING SUCH LAMP

(75) Inventors: Charles M. Coushaine, Rindge, NH (US); Paul R. Lyman, Guilford, VT (US)

(73) Assignee: Osram Sylvania Inc., Danvers, MA (US)

( * ) Notice: Subject to any disclaimer, the term of this patent is extended or adjusted under 35 U.S.C. 154(b) by 247 days.

(21) Appl. No.: 10/647,682

(22) Filed: Aug. 25, 2003

(65) Prior Publication Data

US 2005/0047145 A1 Mar. 3, 2005

(51) Int. Cl.[7] ..... F21V 29/00

(52) U.S. Cl. ..... 362/294; 362/247; 362/373; 362/431; 362/800; 257/88

(58) Field of Search ..... 362/247, 294, 362/296, 373, 431, 800, 227, 235, 236, 249, 362/252, 257, 310, 362, 3, 11, 410, 414; 257/88, 89, 98, 99, 79; 313/498; 315/76, 315/130, 133; 340/815.4, 815.45, 815.73, 340/815.75

(56) References Cited

U.S. PATENT DOCUMENTS

| | | | | |
|---|---|---|---|---|
| 6,525,668 | B1 * | 2/2003 | Petrick | 340/815.45 |
| 6,682,211 | B2 * | 1/2004 | English et al. | 362/247 |
| 2003/0016536 | A1 * | 1/2003 | Lin | 362/247 |
| 2003/0214810 | A1 * | 11/2003 | Zhang | 362/294 |

* cited by examiner

*Primary Examiner*—Thomas M. Sember
*Assistant Examiner*—Ismael Negron
(74) *Attorney, Agent, or Firm*—William E. Meyer

(57) ABSTRACT

An LED lamp and a method of making an LED lamp in which the lamp includes a heat conductive post with slots in an exterior of the post, and in which a separate LED assembly is inserted into each of the slots, where each of the LED assemblies has a substrate with an LED at a first end thereof, which is inserted into the slot first, and an electrical conductor that extends from the LED to a second end of the substrate. The electrical conductor is connected to a circuit board that is inside a hollow bottom of the post. A reflector and heat sink are attached to the bottom of the post.

21 Claims, 7 Drawing Sheets

LAMP WITH LED SUBSTRATES SUPPORTED BY HEAT CONDUCTIVE POST, AND METHOD OF MAKING SUCH LAMP

BACKGROUND OF THE INVENTION

The present invention is directed to a lamp with plural light-emitting diodes (LEDs) that are carried on a post surrounded by a reflector, and to a method of making such a lamp.

As is known, light output of an LED depends on its temperature. Temperature must be kept low to ensure efficient light production. Accordingly, it is beneficial to provide an LED lamp that includes plural LEDs with a heat sink for drawing heat away from the LEDs.

It is also desirable to provide a reflector for concentrating light from the plural LEDs. The LEDs may be mounted on a post so that the LEDs are surrounded by and spaced from the reflector. A circuit board provides the necessary electrical components and connections for operating the LEDs that are carried on the post.

However, the arrangement of the reflector, heat sink, circuit board, and post in an LED lamp with plural LEDs and the efficient assembly of these components have presented problems for designers of such lamps. One of the problems is how to efficiently connect the LEDs that are carried on top of the post to a circuit board when the circuit board is carried at a base of the post and when the heat sink and reflector are also carried at the base of the post. Heat must conducted away from the LEDs at the top of the post to the heat sink at the bottom of the post and electrical connections must be made from the circuit board at the bottom of the post to the LEDs at the top of the post, and the arrangement of the components must facilitate automated manufacture of the lamp.

SUMMARY OF THE INVENTION

An object of the present invention is to provide a novel LED lamp and method of making an LED lamp that facilitates assembly of the lamp.

A further object of the present invention is to provide a novel LED lamp and method of making the lamp in which LEDs are mounted on separate substrates that include electrical leads for connecting the LEDs to a circuit board and the separate substrates are inserted into slots in an exterior of a post that supports the LEDs.

A yet further object of the present invention is to provide a novel LED lamp and method of making the LED lamp in which the lamp includes a heat conductive post with slots in an exterior of the post, and in which a separate LED assembly is inserted into each of the slots, where each of the LED assemblies has an elongated substrate with an LED at a first end thereof, which is inserted into the slot first, and an electrical conductor that extends from the LED to beyond a second end of the substrate, where the extended part of the electrical conductor at the second end of the substrate is connected to a circuit board at the base of the post.

These and other objects and advantages of the invention will be apparent to those of skill in the art of the present invention after consideration of the following drawings and description of preferred embodiments.

DESCRIPTION OF PREFERRED EMBODIMENTS

Figure 1:
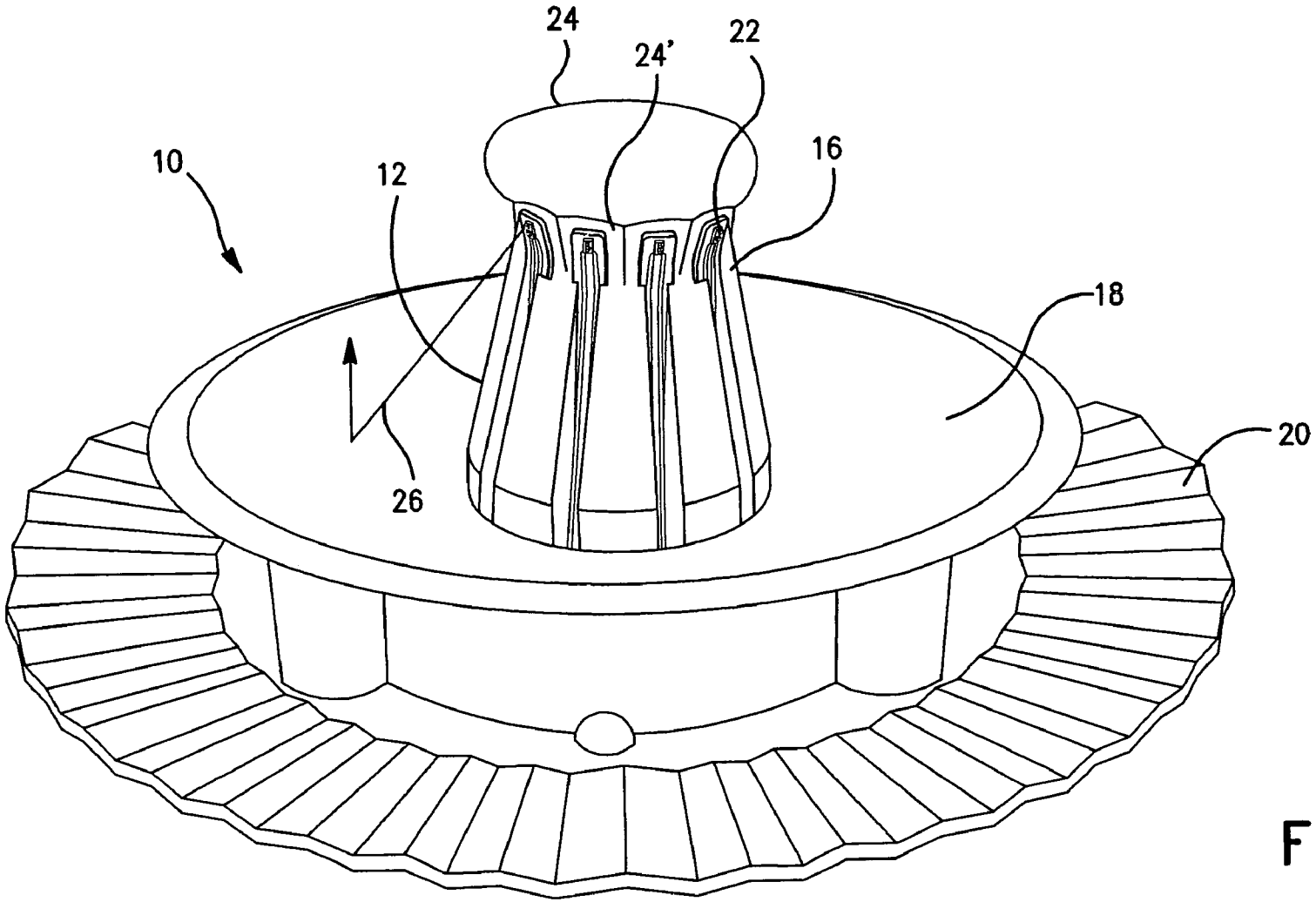
FIG. 1 is a pictorial representation of an embodiment of an LED lamp of the present invention.
Figure 2:
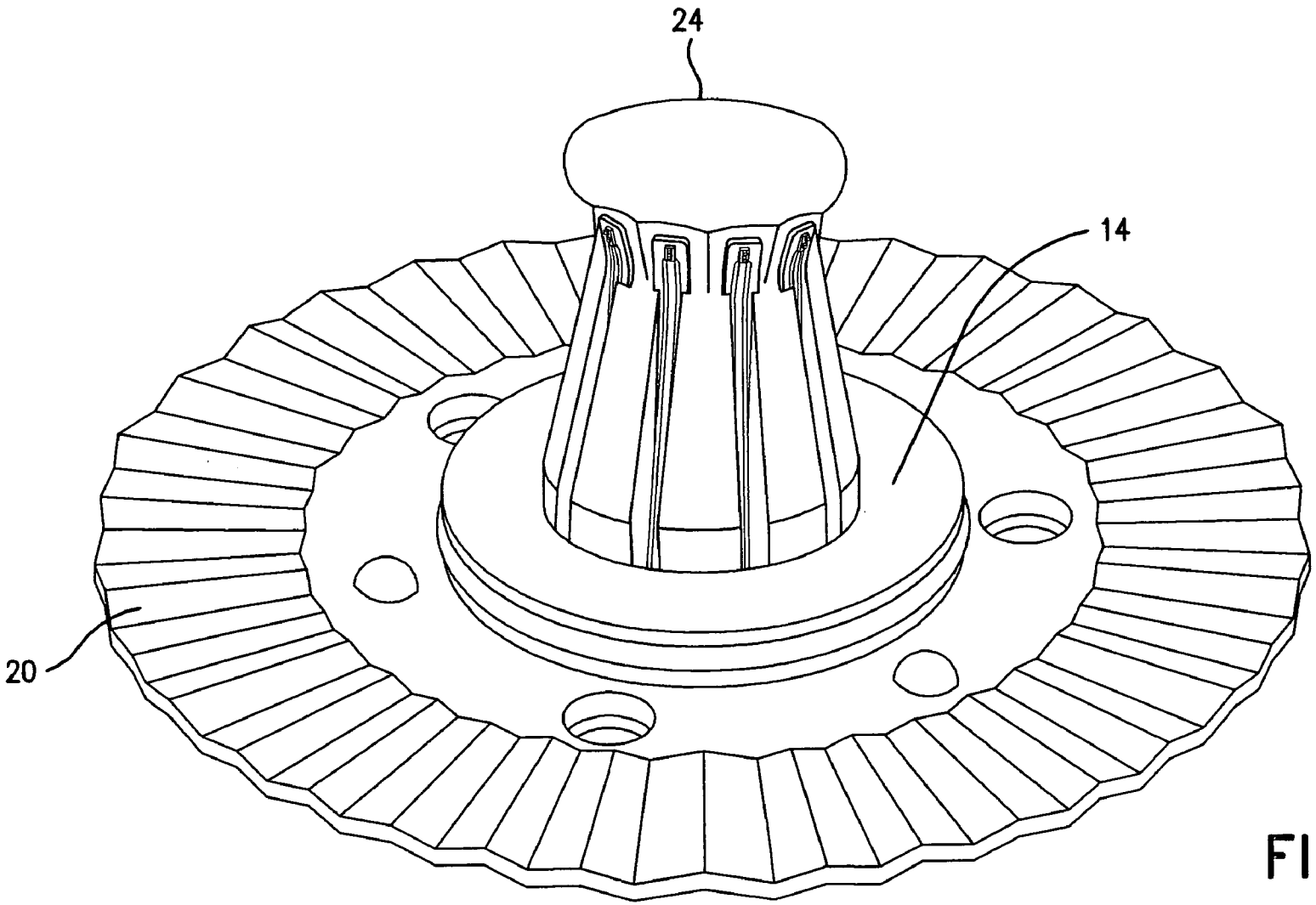
FIG. 2 is a pictorial representation of the embodiment of FIG. 1 with the reflector removed.
Figure 3:
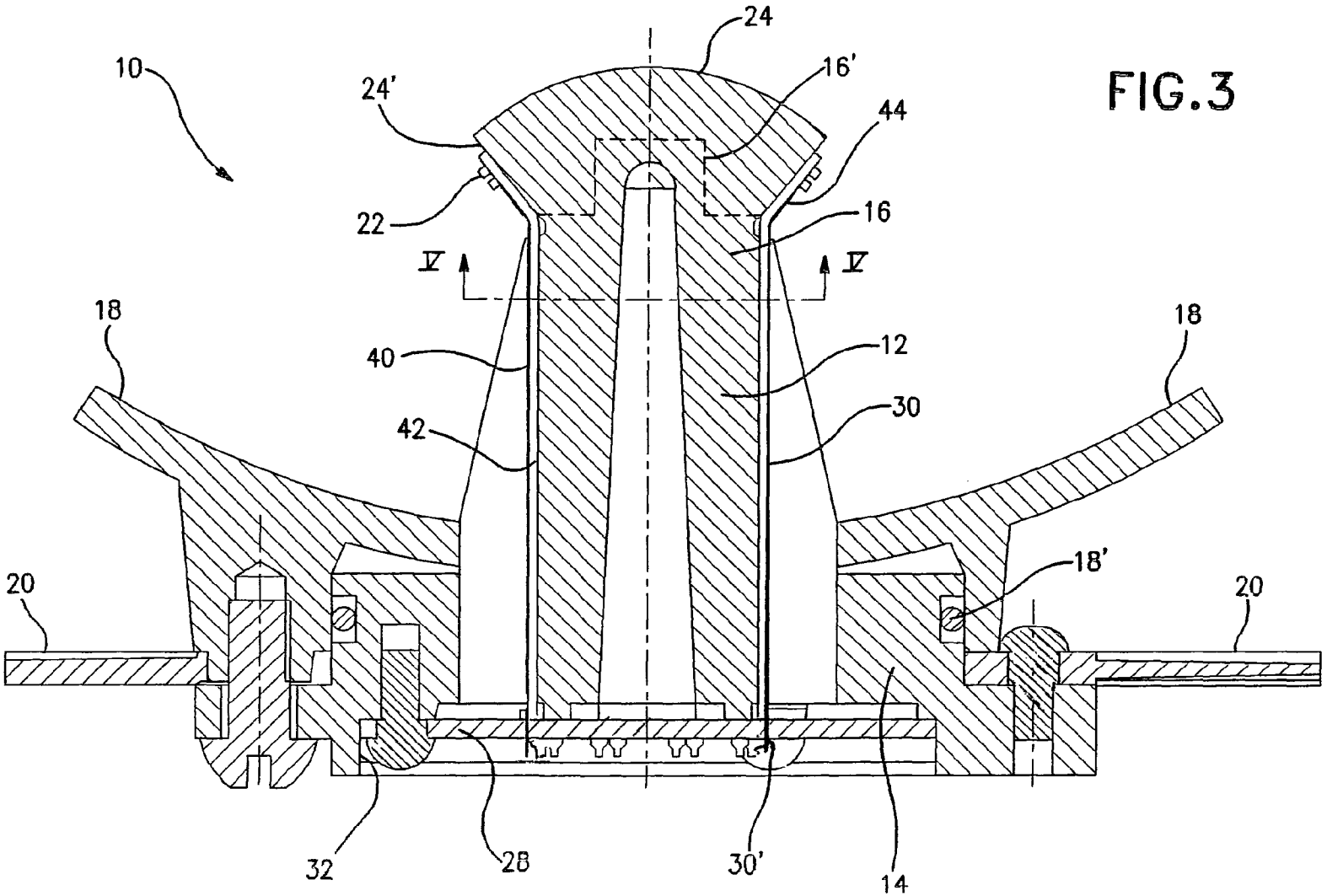
FIG. 3 is a vertical cross sectional view of an embodiment of the present invention.

With reference now to FIGS. 1 and 2, an embodiment of an LED lamp 10 of the present invention includes a heat conductive post 12 having a base 14 and a top 16, a reflector 18 attached to base 14 and a heat sink 20 attached to base 14. The attachment of reflector 18 and heat sink 20 to base 14 is apparent from FIG. 2 that shows lamp 10 with reflector 18 removed. Heat sink 20 may be any suitable material, such as cast zinc or aluminum. Suitable fasteners (such as shown in FIG. 3) hold reflector 18 and heat sink 20 to base 14. The reflector, heat sink and fasteners shown in the figures are offered by way of example, with other designs, shapes, sizes and methods of attaching the reflector and heat sink being adaptable to the present invention as appropriate for a particular purpose, size and design of the lamp.

LEDs 22 are mounted on a periphery of a head 24 that is on top 16 of post 12. Head 24 may include flat portions 24' for receiving LEDs 22. The number of LEDs 22 depends on the application for the lamp, and in one embodiment ten LEDs 22 are mounted on respective flat portions 24' around a periphery of head 24. Flat portions 24' preferably extend around head 24 in equal steps, and are angled with respect to the lamp axis generally to direct light from LEDs 22 to reflector 18 and not to the field to be illuminated. For example, as illustrated by light beam 26, reflector 18 and LEDs 22 are arranged so that light from LEDs 22 is projected toward reflector 18 and reflected in a manner suitable for the purpose of lamp 10. As will be explained further below and shown in FIG. 3, a circuit board 28 with components for operating LEDs 22 may be carried at a bottom of base 14 and connected to LEDs 22 with electrical conductors 30.

The connection of LEDs 22 to circuit board 28 will now be discussed with reference to FIGS. 3–5. As shown in FIG. 3, base 14 may be part of (or an extension of) a bottom of post 12 and head 24 may be part of (or an extension of) top 16 at the other end of post 12. The entirety of post 12, including base 14, top 16 and head 24 desirably is one piece of metal that has high thermal conductivity, such as cast zinc that may be metallized for aesthetics. Several parts could be joined to form post 12, but assembly would be more difficult and heat conduction may be impaired. Base 14 may be stepped to receive heat sink 20 and have appropriate connections and an O-ring 18' for securing reflector 18. Base 14 may have a central recess 32 therein that receives circuit board 28 (the circuitry not being shown as it is known to those of skill in the art). Recess 32 desirably has sufficient depth so that circuit board 28 does not protrude from the bottom of base 14.

Figure 4A:
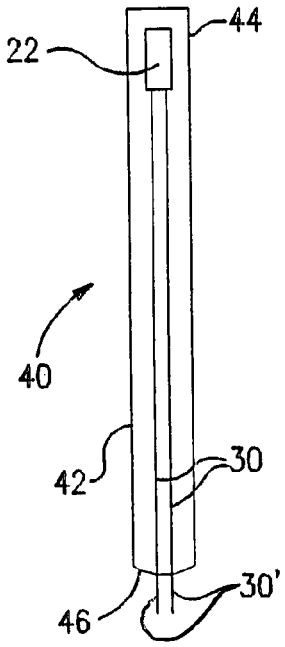
FIGS. 4(*a*)–(*c*) are pictorial representations of one embodiment of an LED assembly of the present invention showing, respectively, a front view, a side view before the assembly is inserted into the post, and a side view with the first end bent after insertion into the post.
Figure 4B:
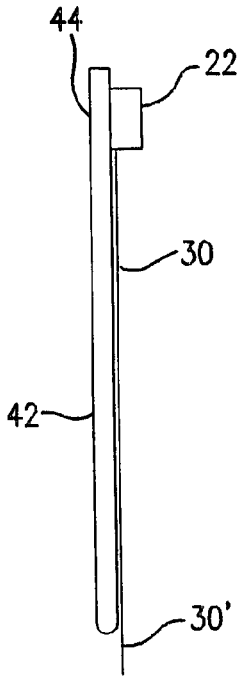
Figure 4C:
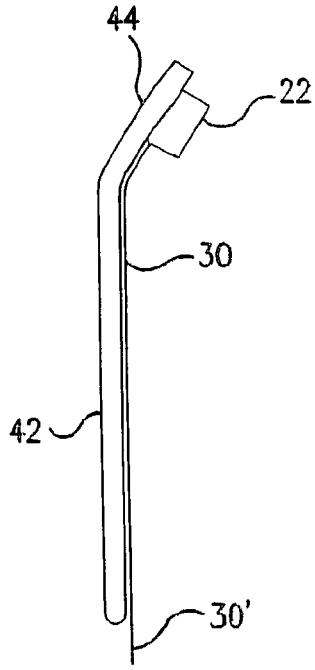
Figure 5:
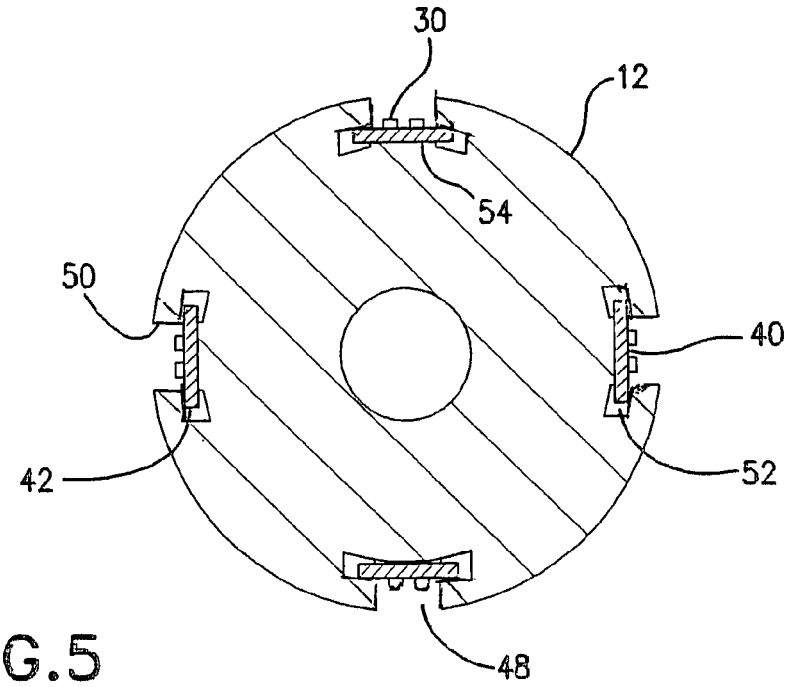
FIG. 5 is cross section V—V of FIG. 3 showing the wireways and inserted LED assemblies.

With reference to FIGS. 4–5, connection of LED 22 to circuit board 28 may be made by using LED assemblies 40 that each include an elongated substrate 42 with an LED 22 at a first end 44 thereof and electrical conductors 30 that extend from LED 22 to or beyond a second end 46 of substrate 42. Each LED assembly 40 may be separate and inserted into a separate wireway 48 in post 12 so that each LED 22 is placed in a heat conductive relationship with heat sink 20 through substrate 42 and post 12. Each flat portion 24' may have a separate wireway 48 leading thereto. Preferably, and as will more fully described below, each wireway 48 may be an axially extended slot with overhanging edges or projections forming retaining elements on the side walls of the slot. LED assembly 40 may slide into the slot axially with the edges of the LED assembly retained in the retaining elements.

When LED assembly 40 is inserted in wireway 48 from base 14 (first end 44 being inserted first in the preferred embodiment), first end 44 is bent as it approaches head 24 during insertion so that LED 22 assumes the proper projection angle. To this end, substrate 42, or at least a part thereof at first end 44, should be sufficiently flexible to bend during insertion. A suitable substrate material is electrically insulative, thermally conductive about and about 0.5 mm thick. Electrical conductors 30 may be metallized traces on substrate 42, wires, or other suitably flexible electrically conductive material. An insulative cover may be provided so that electrical conductors 30 do not contact walls of wireway 48 or the electrical conductors 30 may be offset from the wireway walls to avoid contact therewith. FIG. 3 illustrates the fully inserted LED assembly 40 with first end 44 bent at head 24. First end 44 may be attached to head 24 (preferably to flat portion 24' of head 24 that has been given the proper angle) using an appropriate adhesive or by other means.

With reference to FIGS. 3–4, each electrical conductor 30 has a conductive end 30' that extends beyond second end 46 of substrate 42. Conductive end 30' extends to circuit board 28 for connection thereto, or preferably extends entirely through circuit board 28, such as shown in FIG. 3, so that electrical connections can be easily completed. Conductive ends 30' and its respective electrical conductor 30 may be a single element or may be two separate elements, with conductive end 30' being attached to electrical conductor 30.

In an alternative assembly embodiment, head 24 is removed from top 16 (such as indicated by dashed line 16') and LED assembly is inserted into top 16 (second end 46 being inserted first). In this event, first end 44 may be pre-bent or bent when head 24 is attached. Head 24 then may be press fit to top 16.

FIG. 5 shows a cross section of post 12 with plural wireways 48. As noted above, the number of LEDs may vary and the number of wireways 48 desirably corresponds to the number of LEDs. Each wireway 48 may be generally T-shaped in cross section with an open exterior slot 50 at a base of the T-shape and an interior cavity 52 that may be wider than slot 50 and defining a cap of the T-shape. LED assembly 40 may be carried in interior cavity 52 (the inwardly projecting walls defining the cavity being an example of the above-mentioned retaining element), or at a base of slot 50. Instead of being T-shaped, wireway 48 may have side projections (e.g., fingers, bumps) from a side wall that hold LED assembly 40 therein. Slot 50 desirably is wider than respective electrical conductors 30 so that electrical conductors 30 avoid contact with post 12. Further, if LED assembly 40 is being inserted into base 14, slot 50 should also be wider than LED 22 to allow room for passage of LED 22 during insertion of LED assembly 40 into wireway 48.

Interior cavity 52 may have a rear projection 54 therein that presses against a back of substrate 42 while the walls of cavity 52 press against the front. Rear projection 54 should assure a tight radial fit for substrate 42 so that there is good thermal conduction from LEDs 22 to post 12, which conducts heat to heat sink 20.

Figure 6:
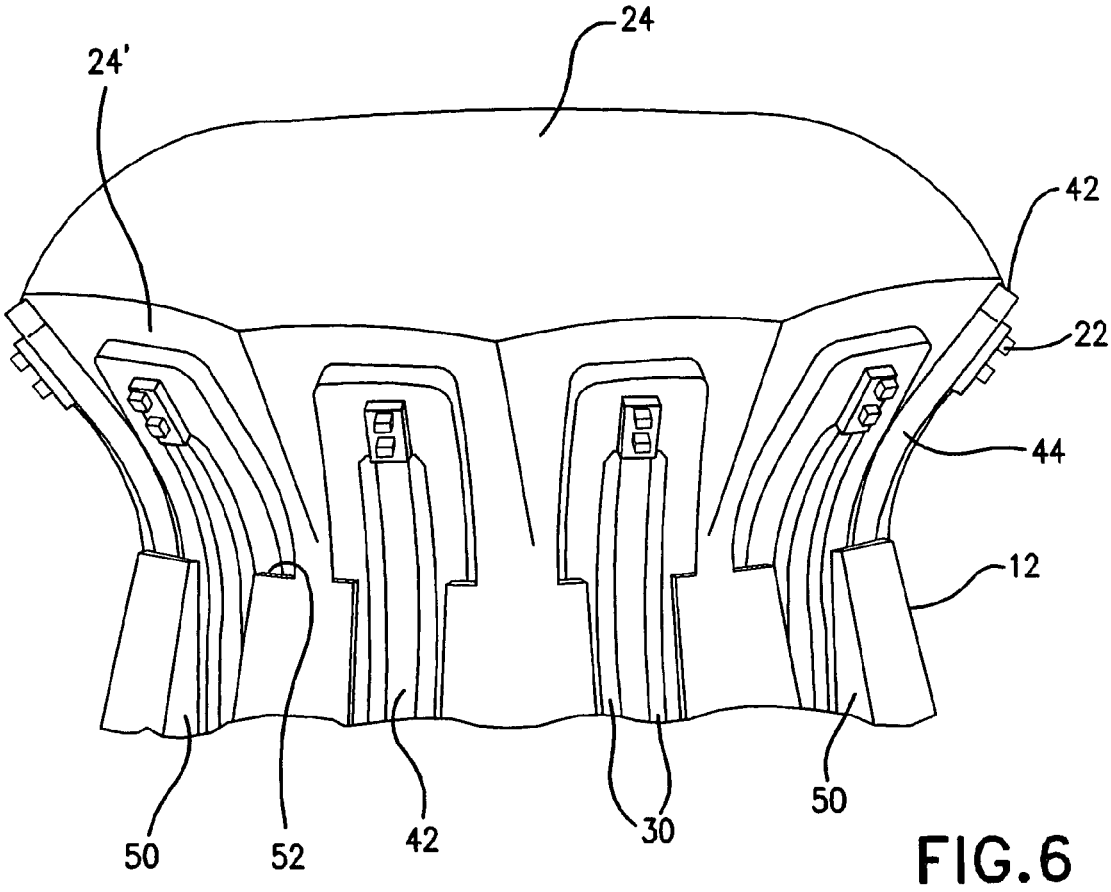
FIG. 6 is a partial pictorial representation of the head of the post of FIG. 1 with LED assemblies mounted thereon.
Figure 7:
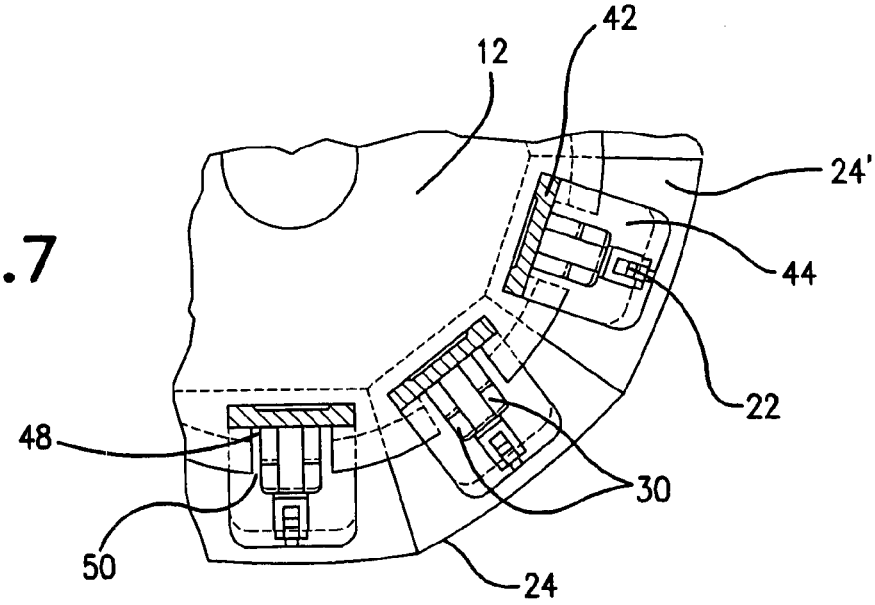
FIG. 7 is a partial top view of the embodiment of FIG. 1 that includes ghost images of inserted LED assemblies.

FIG. 6 is a more detailed view of the arrangement of first ends 44 of LED assemblies 40. The bending of first end 44, the relationship of slot 50 to electrical conductor 30, and an arrangement of LEDs 22 is illustrated by way of example. By way of further explanation, FIG. 7 shows a part of the embodiment of FIG. 6 with ghost images of LED assemblies 40 (as seen through head 24). The T-shaped wireways 48 and relative sizes of slot 50, electrical conductor 30, and LED 22 in this embodiment are also visible.

Figure 8A:
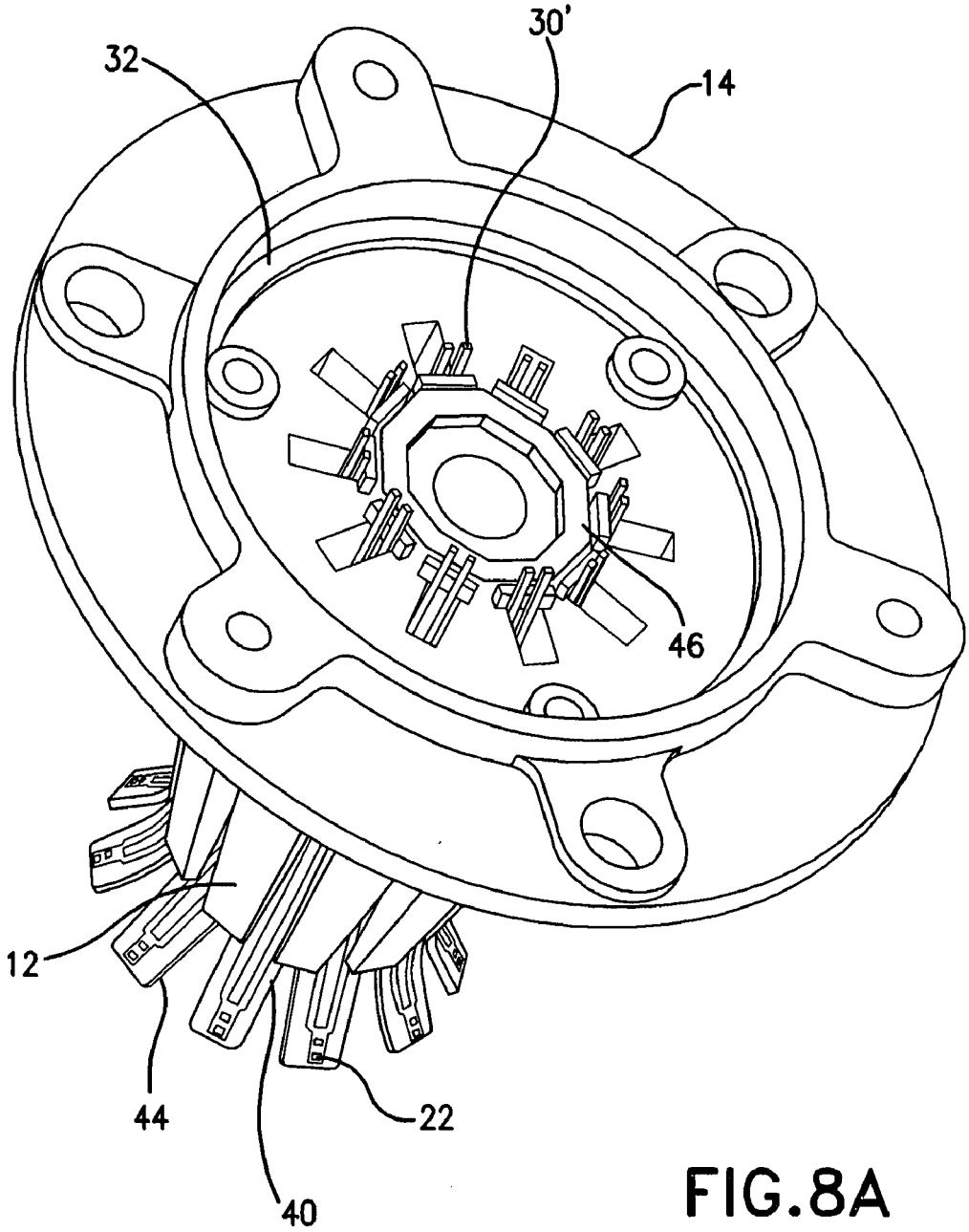
FIGS. 8(*a*)–(*b*) are pictorial representations showing a sequence of assembly of the embodiment of FIG. 1.
Figure 8B:
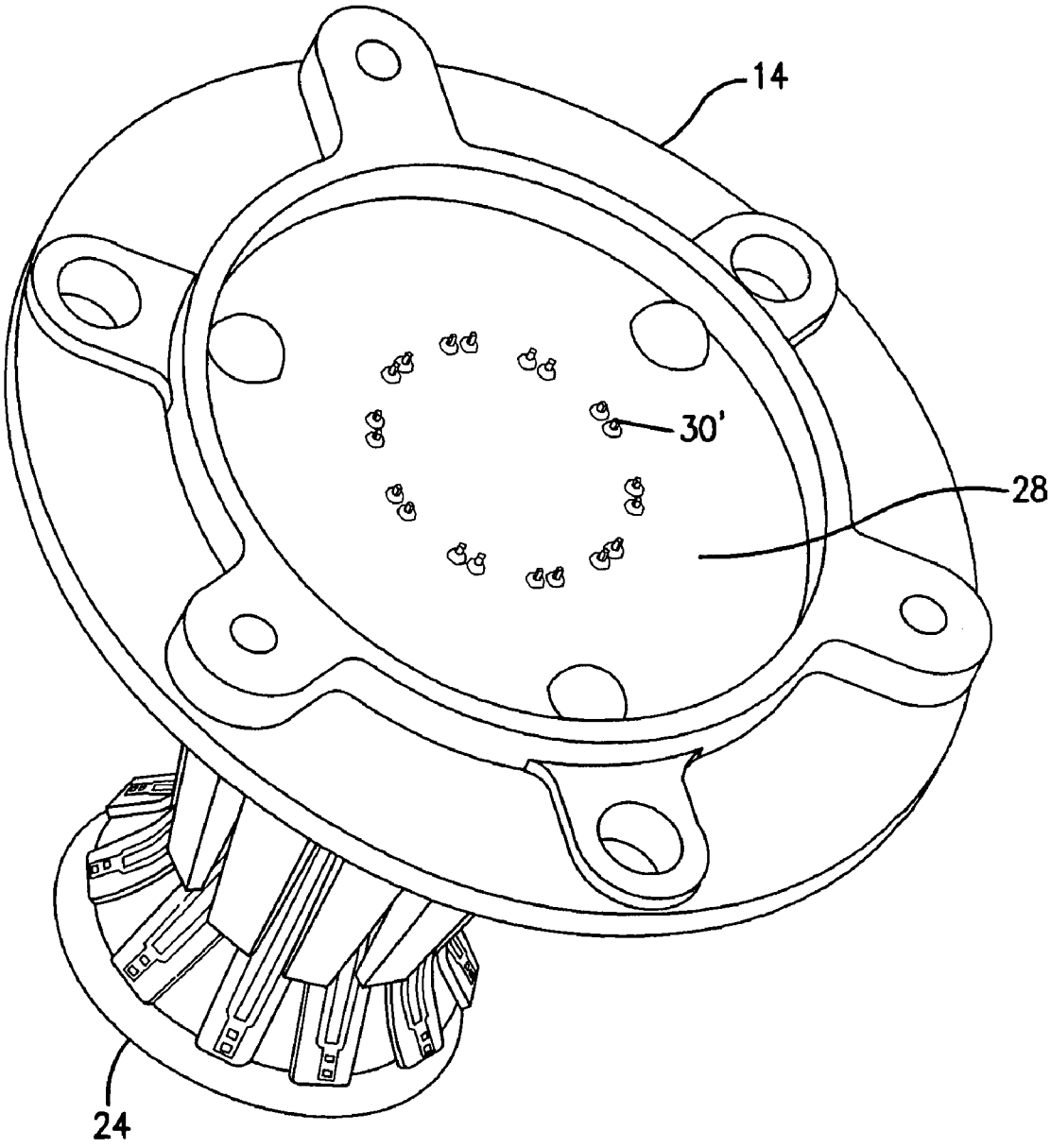

FIGS. 8(*a*)–(*b*) show a sequence of assembly of an embodiment of the present invention, as seen from the bottom of base 14. In FIG. 8(*a*) are seen extensions of wireways 48 to base 14 (specifically, the openings of slots 50 and interior cavities 52 through base 14), second ends 46 of LED assemblies 40, and ends 30' of electrical conductors 30. At this stage of assembly, LED assemblies 40 have been inserted into wireways 48. Head 24 may already be in place if LED assemblies 40 are inserted through bottom 14 or added later if LED assemblies 40 are inserted through top 16. FIG. 8(*b*) illustrates the placement of circuit board 28 and the extension of ends 30' through circuit board 28 so as to facilitate electrical connection. Heat sink 20 and reflector 18 may be attached at an appropriate stage of assembly.

The LED lamp and method described herein provides several production advantages. For example, individual LEDs need not be soldered to the post one by one. The LEDs and their electrical leads may be carried on substrates that can be pre-assembled and the pre-assembled substrates may be machine mounted in the post. In addition, the space for the circuit board may be sufficiently large to permit component separation and thermal dissipation, the connection of electrical leads to the circuit board can be highly automated, the heat sink may have a myriad of shapes as needed for particular applications, and the fit tolerance of the various parts may be set so that manufacturing cost and complexity can be reduced.

While embodiments of the present invention have been described in the foregoing specification and drawings, it is to be understood that the present invention is defined by the following claims when read in light of the specification and drawings.

What is claimed is:

1. A lamp comprising:

a heat conductive post having a bottom and a top and longitudinal recesses in an exterior of said post extending from the bottom to the top, said recesses defining plural wireways;

plural light-emitting diode (LED) assemblies that each comprise a substrate with an LED at a first end thereof and an electrical conductor that extends from said LED to a second end of said substrate, each of said LED assemblies being in a different one of said wireways and in a heat conductive relationship with said post, the first end of said substrate being at the top of said post; and a circuit board that is at the bottom of said post and connected to said electrical conductor.

2. The lamp of claim 1, wherein sides of each of said wireways has inward projections that hold a respective one of said LED assemblies.

3. The lamp of claim 1, wherein said first end of said substrate is bent relative to a remainder of said substrate.

4. The lamp of claim 1, further comprising a reflector attached to the bottom of said post, and wherein each said LED faces said reflector so that light from each said LED is directed to and reflected from said reflector.

5. The lamp of claim 1, further comprising a heat sink attached to the bottom of said post.

6. The lamp of claim 1, wherein the bottom of said post has a hollow therein and said circuit board is in said hollow.

7. The lamp of claim 1, wherein said electrical conductor comprises a wire that extends beyond said second end of said substrate and wherein said wire extends entirely through said circuit board.

8. The lamp of claim 1, wherein each of said wireways is generally T-shaped in cross section with an open exterior slot at a base of the T-shape and an interior cavity wider than said slot defining a cap of the T-shape, and wherein said substrate is carried in said interior cavity.

9. The lamp of claim 8, wherein said slot is wider than said electrical conductor.

10. The lamp of claim 8, wherein said interior cavity has a projection therein that presses against a bottom of said substrate.

11. A lamp comprising:

a thermally conductive base;

a thermally conductive post having at least one slot with retaining elements, said post being in a thermally conductive relationship with said base;

an LED mounted on a substrate, said substrate being retained in said at least one slot by said retaining elements with said LED adjacent to a top of said post, said LED being in a thermally conductive relationship with said post;

said substrate further having an electrical connection for said LED that extends to a distal end of said substrate; and a circuit board retained in said base and electrically coupled to said electrical connection.

12. The lamp of claim 11, wherein said at least one slot has a projection therein that presses against a bottom of said substrate.

13. The lamp of claim 11, further comprising a reflector attached to said base and wherein said LED and said reflector are arranged so that light from said LED is reflected from said reflector.

14. The lamp of claim 11, further comprising a heat sink attached to said base.

15. A method of making a lamp, comprising the steps of:

providing a heat conductive post having a bottom and a top and longitudinal recesses in an exterior of the post extending from the bottom to the top, the recesses defining plural wireways;

inserting a different one of plural LED assemblies into each of the plural wireways so that each of the LED assemblies is in a heat conductive relationship with the post, each of the LED assemblies having a substrate with an LED at a first end thereof adjacent to the top of the post and an electrical conductor that extends from the LED to a second end of the substrate;

mounting a circuit board for the LED assemblies at the bottom of the post; and connecting each electrical conductor to the circuit board.

16. The method of claim 15, wherein each of the LED assemblies is held in a respective one of the wireways with projections from sides of the respective one of the recesses that press against sides of the substrate.

17. The method of claim 15, wherein each of the LED assemblies is held in a respective one of the wireways with a projection from a bottom of the respective one of the recesses that presses against a back of the substrate.

18. The method of claim 15 further comprising the step of attaching a reflector and a heat sink to the bottom of the post, the reflector and the LED being arranged so that light from the LED reflects from the reflector.

19. The method of claim 15, further comprising the steps of providing a hollow at the bottom of the post and mounting the circuit board in the hollow.

20. The method of claim 15, wherein the first end of the substrate is initially inserted through the bottom of the post.

21. The method of claim 20, wherein the inserting step comprises the step of bending the first end of the substrate relative to a remainder of the substrate when the first end reaches the top of the post during insertion.

* * * * *